US005411571A

United States Patent [19]

Kobayashi et al.

[11] Patent Number: 5,411,571

[45] Date of Patent: May 2, 1995

[54] HARD SINTERED ALLOY HAVING FINE PORES AND PROCESS FOR PREPARING THE SAME

[75] Inventors: Masaki Kobayashi; Tatuya Sato, both of Kawasaki, Japan

[73] Assignee: Toshiba Tungaloy Co., Ltd., Kawasaki, Japan

[21] Appl. No.: 93,011

[22] Filed: Jul. 19, 1993

[30] Foreign Application Priority Data

Jul. 21, 1992 [JP] Japan ..... 4-215517

[51] Int. Cl.[6] ..... C22C 29/00

[52] U.S. Cl. ..... 75/232; 75/235; 75/236; 75/239; 75/240; 75/241; 75/242; 75/243; 75/244; 75/246; 428/547; 428/550; 428/552; 428/565

[58] Field of Search ..... 75/232, 235, 236, 239, 75/240, 241, 242, 243, 244, 246; 428/550, 551, 552, 565, 568, 569, 547

[56] References Cited

U.S. PATENT DOCUMENTS 4,925,490 5/1990 Nagai et al. ..... 75/238
4,971,624 11/1990 Clark et al. ..... 75/238
5,288,676 2/1994 Shimada et al. ..... 501/93

FOREIGN PATENT DOCUMENTS 57-205372A 12/1982 Japan .
1777279 1/1970 United Kingdom .

*Primary Examiner*—Ngoclan T. Mai
*Attorney, Agent, or Firm*—Foley & Lardner

[57] ABSTRACT

Disclosed are a hard sintered alloy having fine pores which comprises a sintered alloy comprising 2 to 30% by volume of a dispersed phase of at least one of oxide, carbide and sulfide of Ca, Sr or Ba and mutual solid solutions of these, and the balance of a binder phase comprising at least one metal of Co, Ni and Fe or an alloy containing said metal as a main component and a hard phase of at least one of carbide, nitride and boride of the 4a (Ti, Zr, Hf), 5a (V, Nb, Ta) or 6a (Cr, Mo, W) group metal of the periodic table and mutual solid solutions of these, with a volume ratio of said binder phase to said hard phase being 2:98 to 95:5, wherein fine pores are formed by removing said dispersed phase from a surface portion of said sintered alloy, and a process for preparing the same.

20 Claims, No Drawings

HARD SINTERED ALLOY HAVING FINE PORES AND PROCESS FOR PREPARING THE SAME

BACKGROUND OF THE INVENTION

This invention relates to a hard sintered alloy having the surface on which fine pores are formed or can be formed, and a process for preparing the same, more specifically to a hard sintered alloy having fine pores suitable for cutting tools such as insert tip, a drill and an end mill, plastic working tools such as a drawing mold, a die mold and a forging mold, shearing tools such as a punching tool and a slitter, and sliding materials such as mechanical seal and a bearing, and a process for preparing the same.

Hard sintered alloys such as a hard metal, a TiC/TiN-based cermet, a boride-based cermet, ferro-TiC and high-speed steel by powder metallugy, which are obtained by sintering hard powder such as WC, TiC, TiN, VC and MoB and metal powder such as Co, Ni and Fe according to powder metallugy, have excellent strength, toughness and wear resistance so that they have been widely used as various structural parts represented by cutting tools, wear parts and sliding materials. In cutting of an aluminum alloy, a Ti alloy and stainless steel which are easily welded, plastic working in which remarkable damage is caused by contact bonding of a material to be processed and a bearing with high precision which requires low rotary torque even at high surface pressure, a working solution or a lubricating oil have generally been used in order to ensure wear resistance, seizure resistance and lubricity. Even in these uses, there are required to effect high-speed processing, increase efficiency and elongate a life, but improvement of a working solution or a lubricating oil alone cannot cope with these demands.

Therefore, there have been proposed techniques of reducing friction and wear by dispersing pores in a sintered hard metal and impregnating the pores with lubricating oil or a solid lubricant, and representative examples thereof are described in Nishimura et al., "Powder and Powder Metallurgy", 36 (1989), 105 and Japanese Patent Publication No. 1383/1988.

Among the conventional techniques, in a hard metal for sliding of Nishimura et al. in which pores are dispersed, a spherical resin is added to starting powder and the resin is volatilized during sintering under heating to form dispersed pores. In this hard metal of Nishimura et al., pores are dispersed uniformly, but there are problems that the average diameter of the pores is large and remarkably fluctuated and the pores are formed from an inner portion to a surface portion of the hard metal so that strength and hardness are low and its application is limited. Further, the pores formed by volatilization of the resin during sintering under heating disappear as sintering proceeds so that there is also a problem in manufacture control that it is difficult to control the amount and average diameter of the pores.

On the other hand, Japanese Patent Publication No. 1383/1988 discloses an iron based sliding material in which surface portion voids at a depth of 1 mm from the sliding surface comprising 5 to 50% by weight of TiCN and the balance of an iron alloy is 7 to 20% by volume and an inner voids is made smaller than said ratio. When the iron based sliding material described in the above patent publication is used under conditions of using lubricating oil, the voids at the surface portion are impregnated with the oil to reduce friction and wear to a great extent. However, there are problems that it is extremely difficult to control the amount and size of the voids in press molding and sintering steps in powder metallugical techniques and it is also extremely difficult to make the voids remain only at a very surface portion so that strength and hardness are low and its application is limited.

SUMMARY OF THE INVENTION

An object of the present invention is to solve the problems as described above, more specifically to provide a hard sintered alloy having high strength and high hardness, and showing less friction and wear by a liquid-holding effect, which is obtained by incorporating a dispersed phase of at least one of oxide, carbide and sulfide of Ca, Sr or Ba and solid solutions of these into a hard sintered alloy and then removing the dispersed phase existing at a surface portion of the hard sintered alloy to form fine pores, and a process for preparing the same.

The present inventors have studied porous sintered alloys, and found that when pores are formed only at a surface portion of a sintered alloy and an inner portion of the sintered alloy is made a dense structure, the whole sintered alloy has high strength and it is possible to utilize maximally a lubricating effect of a lubricating substance, for example, oil by impregnating the pores at the surface portion with oil; the pores can be distributed uniformly only at the surface portion of the sintered alloy by dissolving and removing a specific substance from the surface portion of the sintered alloy in which the specific substance is dispersed uniformly to form the pores; and as the specific substance, oxide, carbide and sulfide of Ca, Sr or Ba are suitable, to accomplish the present invention.

The hard sintered alloy having fine pores of the present invention is a hard sintered alloy which comprises 2 to 30% by volume of a dispersed phase of at least one of oxide, carbide and sulfide of Ca, Sr or Ba and solid solutions of these, and the balance of a binder phase comprising at least one metal of Co, Ni and Fe or an alloy containing said metal as a main component and a hard phase of at least one of carbide, nitride and boride of the 4a (Ti, Zr, Hf), 5a (V, Nb, Ta) or 6a (Cr, Mo, W) group metal of the periodic table and solid solutions of these, with a volume ratio of said binder phase to said hard phase being 2:98 to 95:5, wherein fine pores are formed by removing said dispersed phase from a surface portion of said sintered alloy.

Also, a process for preparing the alloy of the present invention comprises:

a first step of mixing a dispersed phase-forming material of at least one of a metal, oxide, carbide, sulfide, hydroxide, hydride, carbonate, sulfate, nitrate and carboxylate of Ca, Sr or Ba, binder phase-forming powder comprising a metal or alloy containing at least one of Co, Ni and Fe as a main component, hard phase-forming powder of at least one of carbide, nitride and boride of the 4a, 5a or 6a group metal of the periodic table and solid solutions of these and, if necessary, carbon and/or boron nitride powder and pulverizing the mixture to obtain mixed powder;

a second step of molding said mixed powder into a predetermined shape to obtain a molded compact;

a third step of sintering said molded compact under heating to 1,000° to 1,600° C. under vacuum or non-oxidizing atmosphere to obtain a sintered alloy containing a dispersed phase of at least one of oxide, carbide and sulfide of Ca, Sr or Ba and solid solutions of these; and if necessary, a fourth step of contacting the surface of said sintered alloy with water or a solvent to remove said dispersed phase existing at a surface portion of said sintered alloy, whereby fine pores are formed.

DESCRIPTION OF THE PREFERRED EMBODIMENTS

In the following, the present invention is explained in detail.

As the dispersed phase in the hard sintered alloy of the present invention, there may be mentioned, for example, CaO, SrO, BaO, $CaC_2$, $SrC_2$, $BaC_2$, CaS, SrS, BaS, (Ca, Sr)O and Sr(O,S). Among these dispersed phases, carbide and sulfide react with water or moisture to generate acetylene or hydrogen sulfide so that a dispersed phase comprising an oxide is preferred in the points of safety control and quality control. The average particle size of the dispersed phase corresponds to the average diameter of the fine pores. The average particle size of the dispersed phase and the average diameter of the fine pores are preferably 0.5 to 20 μm, particularly preferably 2 to 5 μm although they vary depending on use conditions. If the average diameter of the fine pores is less than 0.5 μm, impregnation with a lubricating substance is weak, while if it exceeds 20 μm, lowering of strength and wear of the hard sintered alloy are remarkable.

When the content of this dispersed phase is less than 2% by volume, the fine pores formed at the surface portion of the hard sintered alloy is also less than 2% by volume so that an effect of a lubricating substance such as oil with which the fine pores are impregnated is small, whereby wear resistance is lowered significantly. On the other hand, if the content of the dispersed phase exceeds 30% by volume, the amount of the dispersed phase existing in the hard sintered alloy is large and the number of the fine pores formed at the surface portion of the hard sintered alloy are large, whereby worsening of wear resistance caused by lowering of hardness and lowering of strength are remarkable. The content of the dispersed phase is particularly preferably 5 to 15% by volume although it varies depending on use conditions.

As the binder phase in the hard sintered alloy of the present invention, there may be mentioned, for example, Co, Ni, Fe, Co-Ni, Co-Cr, Ni-Cr, Ni-Mo, Fe-Cr-Ni, Ni-B, Co-B, or alloys or mixtures containing the above materials and an element(s) forming the hard phase. Among these binder phases, a Co, Ni or Fe based alloy containing 2% by weight or more of Cr is preferred when corrosion resistance is important, and a martensite containing Fe-C as main component(s) is preferred when wear resistance is important.

As the hard phase in the hard sintered alloy of the present invention, there may be mentioned, for example, WC, TiC, NbC, $Cr_3C_2$, $Mo_2C$, $V_4C_3$m TiN, NbN, $TiB_2$, $ZrB_2$, $NbB_2$, $Mo_2NiB_2$, $Mo_2FeB_2$, WCoB, (W, Ti) C, (Ti, Mo) C, (Ti, Ta, W) C, Ti (C, N), (Ti,Nb, W) (C,N), (Ti,W)B, Ti(C,N,B), $M_3C$, $M_6C$ and $M_{23}C_6$ wherein M is at least one of Fe, Co, Ni, Mn, Mo and W.

As to the volume ratio of the binder phase and the hard phase in the hard sintered alloy of the present invention, it is 2:98 to 95:5. If the ratio of the binder phase is less than 2, it is difficult to carry out sintering so that the pores remain in the inner portion, whereby strength and hardness are lowered significantly, while if the ratio of the binder phase exceeds 95, the amount of the hard phase is decreased relatively, whereby wear resistance and seizure resistance are lowered remarkably.

The kinds of the binder phase and the hard phase and their volume ratio in the hard sintered alloy of the present invention are described below. When the binder phase comprises an alloy containing Co and/or Ni as a main component(s) and the hard phase comprises at least one of carbide and nitride of the 4a, 5a or 6a group metal of the periodic table and mutual solid solutions of these, the volume ratio is preferably 2:98 to 50:50. Further, it is preferred that the binder phase is a Co and/or Ni alloy in which W or Mo is dissolved or melted and the hard phase contains one of WC, TiC, TiN and mutual solid solutions of these as a main component. When the binder phase comprises an alloy containing Fe as a main component and the hard phase comprises at least one of carbide and nitride of the 4a, 5a or 6a group metal of the periodic table and mutual solid solutions of these, the volume ratio is preferably 30: 70 to 95: 5. Further, it is preferred that the binder phase is an Fe alloy in which at least one of C, Cr, Mo, W, Ni and Co is dissolved and the hard phase contains one of TiC, VC, WC, TiN and mutual solid solutions of these as a main component. When the binder phase comprises an alloy containing at least one of Co, Ni and Fe as a main component(s) and the above hard phase comprises at least one of boride of the 4a, 5a or 6a group metal of the periodic table, Co, Ni and Fe and mutual solid solutions of these, the volume ratio is preferably 5:95 to 70:30. Further, it is preferred that the binder phase is an alloy of Cr, Mo and/or W and at least one of Co, Ni and Fe, and the hard phase contains complex boride containing Mo and/or W and at least one of Co, Ni and Fe, as a main component. The complex boride is particularly preferably $Mo_2NiB_2$, $Mo_2FeB_2$ and WCoB.

The surface portion of the hard sintered alloy of the present invention refers to a layer thickness in which at least one fine pore exists in the depth direction toward the inner portion from the surface of the hard sintered alloy. In other words, the thickness of the surface portion is at least 0.5 to 20 μm which is the average diameter of the fine pores.

When 10% by volume or less of free carbon and/or boron nitride is incorporated into the hard sintered alloy of the present invention described above, synergistic effect caused by solid lubricity possessed by free carbon and boron nitride and the fine pores described above can be obtained to cause further lowering of a friction coefficient, whereby wear resistance is improved depending on use conditions.

In the hard sintered alloy of the present invention, it is preferred to form a heterogeneous surface layer containing a dispersed phase which is a component of forming the fine pores on the partial or whole surface of a sintered alloy containing no dispersed phase so that strength is further improved. That is, the sintered alloy preferably comprises a hard phase comprising at least one of carbide, nitride and boride of the 4a, 5a or 6a group metal of the periodic table and mutual solid solutions of these and a binder phase comprising at least one metal of Co, Ni and Fe or an alloy containing said metal(s) as a main component(s), with a volume ratio of said binder phase to said hard phase being 2:98 to 95:5, having a heterogeneous surface layer comprising 2 to 30% by volume of a dispersed phase of at least one of oxide, carbide and sulfide of Ca, Sr or Ba and mutual solid solutions of these, 10% by volume or less of free carbon and/or boron nitride and the balance being said hard phase and said binder phase, formed on the partial or whole surface of said sintered alloy, wherein fine pores are formed by removing said dispersed phase from the surface portion of said heterogeneous surface layer.

When the minimum thickness of the heterogeneous surface layer has a size of one particle of the dispersed phase, the lubricating effect as described above can be exhibited by removing the particles of the dispersed phase to form fine pores. On the other hand, the maximum thickness of the heterogeneous surface layer is not particularly limited, and if there exists a sintered alloy portion other than the heterogeneous surface layer, which contains no dispersed phase, there is no problem also in the point of strength. The amount of the dispersed phase in the heterogeneous surface layer may differ depending on the position of the surface of the sintered alloy containing no dispersed phase, and it is rather preferred in practical use that said amount differs since the required amount of the fine pores are formed at a position which requires the fine pores.

The process for preparing the hard sintered alloy of the present invention comprises as mentioned above.

The process for preparing the hard sintered alloy of the present invention having the heterogeneous surface layer is a process which comprises the steps of:

mixing the above binder phase-forming powder and the above hard phase-forming powder and pulverizing the mixture to obtain mixed powder, the second step described above, impregnating or contacting the partial or whole surface of the molded compact with the above dispersed phase-forming material, the third step described above and the fourth step described above; or a process which comprises the steps of:

molding mixed powder of said binder phase-forming powder and said hard phase-forming powder to obtain a first molded compact, contacting the partial surface or plural surfaces of said first molded compact with a second molded compact obtained by molding mixed powder comprising said dispersed phase-forming material, said binder phase-forming powder, said hard phase-forming powder and, if necessary, carbon and/or boron nitride powder, the third step described above and the fourth step described above.

As the dispersed phase-forming material in the preparation processes of the present invention, there may be mentioned, for example, CaO, SrO, BaO, $CaC_2$, $SrC_2$, $BaC_2$, CaS, SrS, BaS, $Ca(OH)_2$, $Sr(OH)_2$, $Ba(OH)_2$, $CaH_2$, $SrH_2$, $BAH_2$, $CaCO_3$, $SrCO_3$, $BaC_3$, $CaS_4$, $SrSO_4$, $BASO_4$, $Ca(NO_3)_2$, $Sr(NO_3)_2$, $Ba(NO_3)_2$, $Ca(CH_3COO)_2$, $Sr(CH_3COO)_2$, $Ba(CH_3COO)_2$ and a metal of Ca, Sr or Ba. Among these materials, carbonates such as $CaCO_3$, $SrCO_3$ and $BaCO_3$ are most preferred since they can be handled easily at the step of mixing and pulverization, and decompose during sintering to generate CaO, SrO and BaO. When the heterogeneous surface layer containing the dispersed phase is formed by impregnation, preferred is $Ca(NO_3)_2$ or $Ca(CH_3COO)_2$ which has a low melting point or is water-soluble.

In the preparation processes of the present invention, starting materials comprising the dispersed phase-forming material, the binder phase-forming powder, the hard phase-forming powder and, if necessary, the carbon and/or boron nitride powder can be formed into mixed powder by a conventional mixing method of powder metallurgy, for example, a ball mill and an attritor. Further, the mixed powder can be formed into a molded compact by, for example, a metal mold pressure molding method, an extrusion molding method, an injection molding method, a sheet molding method, a slip cast method or a centrifugal cast molding method.

In the processes for preparing the hard sintered alloy having the heterogeneous surface layer, "impregnating or contacting the partial or whole surface of the molded compact comprising the binder phase-forming powder and the hard phase-forming powder with the dispersed phase-forming material" refers to, for example, a method of contacting or embedding the dispersed phase-forming material directly, a method of coating a solution obtained by dissolving or dispersing said material in an organic solvent or a method of dipping in said solution. Further, "contacting the partial surface or plural surfaces of the first molded compact containing no dispersed phase-forming material with the second molded compact containing the dispersed phase-forming material" refers to, for example, a method of subjecting the first molded compact to pressure molding in a metal mold, inserting the second molded compact into the metal mold in a state being in contact with the first molded compact and subjecting the molded compacts to pressure molding, a method of mounting a sheet of the second molded compact on the surface of the first molded compact or a method of successively casting a slurry of the second molded compact and that of the first molded compact in order into a slip cast mold.

In the sintering step in the preparation processes of the present invention, sintering is carried out under heating to 1,000° to 1,600° C. under vacuum or atmosphere of at least one of inert, hydrogen, carbon monoxide and carbon dioxide gases depending mainly on the kind of the dispersed phase-forming material to be used as a starting material. It is preferred that after the above molded compact is sintered in a glass or metal vessel by conventionally used hot isostatic press (HIP) treatment or the process described above, the molded compact is subjected to further HIP treatment, whereby it is possible to obtain a sintered alloy having no pore remained in the inner portion and having high strength and excellent wear resistance. The pores remaining on the surface and in the inner portion of the sintered alloy have an effect of reducing friction and wear by impregnation with oil as in the fine pores formed by removing the dispersed phase, but it is difficult to control the amount and size thereof. Therefore, it is preferred that the amount of the pores remaining on the surface and in the inner portion of the sintered alloy is small as far as possible, and said amount is preferably 10% by volume or less, most preferably 2% by volume or less.

In the final step, it is preferred to form fine pores at the surface of the hard sintered alloy by removing the dispersed phase at the surface thereof by bringing the surface in contact with water or a solvent such as acetone and an alcohol, whereby oil is contained in the fine pores of the hard sintered alloy before use or at the initial stage of use. However, even if this step is omitted, there is no problem since the dispersed phase is preferentially crushed to form fine pores by stress accompanied by bringing it in contact with an opposite material when it is used.

The hard sintered alloy of the present invention can contain a lubricating substance such as oil and a working solution in the fine pores formed on the partial or whole surface of the sintered alloy so that the alloy has an indirect effect brought about by the fine pores at the surface portion that this lubricating substance reduces friction and wear caused by bringing it in contact with an opposite material, and the sintered alloy at the inner portion which excludes the surface portion of the alloy has an effect of retaining strength of the sintered alloy.

EXAMPLES

The present invention is described in detail by referring to Examples.

Example 1

Commercially available respective powders of WC, $Cr_3C_2$, Ni, W, Co, carbon (C), a complex carbide mutual solid solution of WC, TiC and TaC (weight ratio:50:20:30, hereinafter abbreviated as "WTT"), TiC, $TiC_{0.5}N_{0.5}$, TaC, $Mo_2C$, BN, Fe, TiN, VC, $TiB_2$, B, Mo, MoB, CrN, WB, $CaCO_3$, $SrCO_3$ and $BaCO_3$ each having average particle sizes in the range of 1 to 3 μm, were weighed and formulated to have the compositions as shown in Table 1. The respective formulations were charged in a pot made of stainless steel with an acetone solvent and balls made of a hard metal and mixed and pulverized for 48 hours, and then dried to obtain mixed powders.

Next, these mixed powders were charged in metal molds, respectively, and subjected to pressurization of 2 ton/cm$^2$ to prepare molded compacts each having a size of about 5.5×9.5×29 mm and ϕ (a diameter) 29 mm ×13 mm. Respective molded compacts were placed on a sheet comprising alumina and carbon fibers, and maintained at temperatures shown in Table 1 for one hour at an atmospheric pressure of $10^{-2}$ Torr (1.33322 Pa) under vacuum to obtain Present samples 1 to 16 and Comparative samples 1 to 8. A part of the sintered alloys were subjected to HIP treatment at an atmospheric pressure of 1,500 arm ($1.519875\times10^8$ Pa) for one hour at temperatures shown in Table 1 to remove pores remaining in the sintered alloys.

The respective sintered alloys thus obtained were subjected to wet grinding with a diamond grinding wheel of 230 mesh to have a size of 4.0×8.0×25.0 mm and ϕ25.0 mm×10.0 mm, respectively, whereby samples were prepared.

By using the former samples having a size of 4.0×8.0×25.0 mm, specific gravity, hardness and flexural strength were measured, and the results are shown in Table 2. After the surfaces of the samples were lapped with 1 μm of diamond paste, the components were identified by X ray diffraction, and the average volumes of the dispersed phase (CaO, SrO and BaO), the binder phase and the hard phase of the respective samples were measured by an optical microscope. The results are also shown in Table 2. After these samples were dipped in water, the samples were observed in the same manner as mentioned above, and the average diameters and volumes of the fine pores formed by removing the dispersed phase were measured.

TABLE 1

| Sample No. | Formulation composition (wt %)* | Sintering temperature (°C.) | Presence or absence of HIP and temperature (°C.) |
|---|---|---|---|
| Present sample 1 | (82WC—1$Cr_3C_2$—13Ni—4W) + 5$SrCO_3$ | 1,420 | Absence |
| Present sample 2 | (82WC—1$Cr_3C_2$—13Ni—4W) + 1.5$SrCO_3$ | 1,420 | Absence |
| Present sample 3 | (82WC—1$Cr_3C_2$—13Ni—4W) + 16$SrCO_3$ | 1,400 | Presence, 1,350 |
| Present sample 4 | (95.8WC—4Co—0.2C) + 5$CaCO_3$ | 1,500 | Absence |
| Present sample 5 | (65WC—1$Cr_3C_2$—24WTT—5Co—5Ni) + 7$BaCO_3$ | 1,420 | Absence |
| Present sample 6 | (31TiC—16$TiC_{0.5}N_{0.5}$—13WC—12TaC—8$Mo_2C$—20Ni) + 15$SrCO_3$ | 1,400 | Absence |
| Present sample 7 | (85.5WC—1$Cr_3C_2$—13Ni—0.5C) + 5$SrCO_3$ | 1,380 | Absence |
| Present sample 8 | (91.5WC—0.5BN—8Co) + 5$CaCO_3$ | 1,420 | Absence |
| Present sample 9 | (87WC—5W—8Co) + 5$SrCO_3$ | 1,420 | Absence |
| Present sample 10 | (76$Cr_3C_2$—24Ni) + 10$CaCO_3$ | 1,250 | Absence |
| Present sample 11 | (56Fe—10Co—10TiN—8VC—10WC—3$Mo_2C$—3$Cr_3C_2$) + 7$SrCO_3$ | 1,200 | Presence, 1,150 |
| Present sample 12 | (33Fe—55TiC—10WC—2$Cr_3C_2$) + 5$BaCO_3$ | 1,350 | Absence |
| Present sample 13 | (75$TiB_2$—4B—21Ni) + 5$CaCO_3$ | 1,400 | Presence, 1,350 |
| Present sample 14 | (5B—45Mo—49Fe—1C) + 15$SrCO_3$ | 1,250 | Absence |
| Present sample 15 | (63MoB—10CrN—27Ni) + 15$BaCO_3$ | 1,250 | Absence |
| Present sample 16 | (37WB—10CrN—53Co) + 10$SrCO_3$ | 1,250 | Absence |
| Present sample 17 | (83.5WC—1$Cr_3C_2$—13Ni—2.5C) + 5$SrCO_3$ | 1,400 | Presence, 1,350 |
| Comparative sample 1 | 82WC—1$Cr_3C_2$—13Ni—4W | 1,380 | Absence |
| Comparative sample 2 | (86WC—1$Cr_3C_2$—13Ni) + 25$SrCO_3$ | 1,400 | Presence, 1,350 |

TABLE 1-continued

| Sample No. | Formulation composition (wt %)* | Sintering temperature (°C.) | Presence or absence of HIP and temperature (°C.) |
|---|---|---|---|
| Comparative sample 3 | 96WC—4Co | 1,500 | Absence |
| Comparative sample 4 | 31TiC—16$TiC_{0.5}N_{0.5}$—13WC—12TaC—8$Mo_2C$—20Ni | 1,400 | Absence |
| Comparative sample 5 | 56Fe—10Co—10TiN—8VC—10WC—3$Mo_2C$—3$Cr_3C_2$ | 1,200 | Presence, 1,150 |
| Comparative sample 6 | 75$TiB_2$—4B—21Ni | 1,400 | Presence, 1,300 |
| Comparative sample 7 | 63MoB—10CrN—27Ni | 1,250 | Absence |

*The total figures in the parentheses are 100 (wt %) and the figures after "+" show the added amounts (weight) based on the amount (weight) in the parenthesis as 100.

TABLE 2

| | Composition of sintered alloy (vol %) | | | | Properties of sintered alloy | | | Fine pores at surface portion | |
|---|---|---|---|---|---|---|---|---|---|
| Sample No. | Dispersed phase | Binder phase | Hard phase | BN, C | Specific gravity | Hardness (HRA) | Flexural strength (kgf/mm²) | Diameter (μm) | Amount (vol %) |
| Present sample 1 | 10SrO | 20(Ni—Cr) | 70WC | 0 | 13.10 | 86.0 | 215 | 2.5 | about 10 |
| Present sample 2 | 3SrO | 21(Ni—Cr) | 76WC | 0 | 13.86 | 87.2 | 260 | 2.1 | about 3 |
| Present sample 3 | 25SrO | 16(Ni—Cr) | 59WC | 0 | 11.46 | 76.5 | 135 | 5.2 | about 25 |
| Present sample 4 | 11CaO | 6Co | 83WC | 0 | 14.04 | 89.8 | 155 | 2.9 | about 11 |
| Present sample 5 | 11BaO | 14(Co—Ni—Cr) | 49WC—26(W,Ti,Ta)C | 0 | 12.32 | 88.5 | 160 | 2.2 | about 11 |
| Present sample 6 | 14SrO | 14(Ni—Mo) | 40TiC—32(Ti,W,Ta,Mo)CN | 0 | 6.80 | 87.9 | 110 | 2.7 | about 14 |
| Present sample 7 | 9SrO | 20(Ni—Cr) | 68WC | 3C | 12.72 | 84.2 | 120 | 2.4 | about 9 |
| Present sample 8 | 10CaO | 12(Co—B) | 74WC | 4BN | 13.04 | 87.0 | 105 | 2.4 | about 11 |
| Present sample 9 | 11SrO | 10Co | 69WC—10$Co_3W_3C$ | 0 | 13.70 | 89.0 | 160 | 1.9 | about 11 |
| Present sample 10 | 11CaO | 19(Ni—Cr) | 80$Cr_3C_2$ | 0 | 6.6 | 83.4 | 135 | 1.7 | about 11 |
| Present sample 11 | 8SrO | 60(Fe—Co—W—Mo—Cr) | 15TiN—12VC—5WC | 0 | 7.45 | 67.4 | 305 | 2.1 | about 8 |
| Present sample 12 | 4BaO | 26(Fe—W—Cr) | 48TiC—22(Ti,W)C | 0 | 6.50 | 72.1 | 220 | 2.0 | about 7 |
| Present sample 13 | 4CaO | 18(Ni—B) | 78$TiB_2$ | 0 | 4.80 | 88.3 | 105 | 3.1 | about 4 |
| Present sample 14 | 16CaO | 31(Fe—Mo) | 53$Mo_2FeB_2$ | 0 | 7.72 | 83.5 | 170 | 2.3 | about 16 |
| Present sample 15 | 15BaO | 24(Ni—Cr) | 61$Mo_2NiB_2$ | 0 | 7.97 | 83.8 | 190 | 2.3 | about 15 |
| Present sample 16 | 13SrO | 25(Co—Cr) | 62WCoB | 0 | 9.62 | 87.3 | 200 | 2.0 | about 13 |
| Present sample 17 | 9SrO | 17(Ni—Cr) | 60WC | 14C | 11.61 | 75.6 | 155 | 3.0 | about 10 |
| Comparative sample 1 | 0 | 22(Ni—Cr) | 88WC | 0 | 14.08 | 87.9 | 295 | — | about 0 |
| Comparative sample 2 | 35SrO | 14(Ni—Cr) | 51WC | 0 | 10.45 | 51.9 | 45 | 9.0 | about 35 |
| Comparative sample 3 | 0 | 7Co | 93WC | 0 | 15.20 | 92.0 | 190 | — | about 0 |
| Comparative sample 4 | 0 | 16(Ni—Mo) | 46TiC—38(Ti,W,Ta,Mo)CN | 0 | 7.10 | 91.4 | 165 | — | about 0 |
| Comparative sample 5 | 0 | 65(Fe—Co—W—Mo—Cr) | 16TiN—13V—6WC | 0 | 7.65 | 70.3 | 340 | — | about 0 |
| Comparative sample 6 | 0 | 19(Ni—B) | 81$TiB_2$ | 0 | 4.87 | 86.4 | 115 | — | about 0 |
| Comparative sample 7 | 0 | 27(Ni—Cr) | 73$Mo_2NiB_2$ | 0 | 8.60 | 85.3 | 220 | — | about 0 |

Example 2

By using the same starting powders and mixing and molding conditions as in Example 1, molded compacts having the formulation compositions as shown in Table 3 were prepared. The molded compacts were contacted with the dispersed phase-forming materials as shown in Table 3 and then sintered in the same manner as in Example 1 to obtain Present samples 18 to 23, each having a size of about 5.5×9.5×29 mm. In Samples No. 18, No. 20, No. 21 and No. 22, the molded compacts were contacted with the dispersed phase-forming materials by coating 0.05 g/cm$^2$ of $Sr(NO_3)_2$ or $Ba(NO_3)_2$ powder uniformly on each one surface (the surface having a size of 9.5×29 mm) of the molded compacts, and in Sample No. 18, the molded compact was contacted with the dispersed phase-forming material by dipping the molded compact in a 20% acetone solution of $Ca(NO_3)_2$, followed by drying. In Samples No. 23 and No. 24, the respective mixed powders were charged successively into a mold and then subjected to pressure molding to obtain laminated molded products each having a predetermined thickness.

The thickness, hardness and average volume of dispersed phase/binder phase/hard phase of each heterogeneous surface layer and the average diameter and volume of the fine pores at the surface port ion were measured in the same manner as in Example 1. The results are shown in Table 4. Further the hardness and average volume of dispersed phase/binder phase at the inner portion of each sintered body and the specific gravity and flexural strength of the whole sintered alloy were measured in the same manner as in Example 1 and the results are shown in Table 5.

TABLE 3

| Sample No. | Formulation composition (vol %)* | Dispersed phase-forming material and contact state | Sintering temperature (°C.) | Presence or absence of HIP and temperature (°C.) |
|---|---|---|---|---|
| Present sample 18 | 82WC—1$Cr_3C_2$—13Ni—4W | $Sr(NO_3)_2$ coating | 1,420 | Absence |
| Present sample 19 | 95.8WC—4Co—0.2C | impregnated with $Ca(NO_3)_2$ solution | 1,500 | Absence |
| Present sample 20 | 31TiC—16$TiCo_{0.5}N_{0.5}$—13WC—12TaC—8$Mo_2C$—20Ni | $Sr(NO_3)_2$ coating | 1,400 | Absence |
| Present sample 21 | 56Fe—10Co—10TiN—8VC—10WC—3$Mo_2C$—3$Cr_3C_2$ | $Sr(NO_3)_2$ coating | 1,200 | Presence, 1,150 |
| Present sample 22 | 63MoB—10CrN—27Ni | embedded in $Ba(NO_3)_2$ | 1,250 | Absence |
| Present sample 23 | First layer: (82WC—1$Cr_3C_2$—13Ni—4W) + 5$SrCO_3$ | 1 mm pressure molding | 1,420 | Absence |
| | Second layer: (82WC—1$Cr_3C_2$—13Ni—4W) + 1.5$SrCO_3$ | 1 mm pressure molding | | |
| | Third layer: 82WC—1$Cr_3C_2$—13Ni—4W | 4 mm pressure molding | | |
| Present sample 24 | First layer: (76$Cr_3C_2$—24Ni) + 10$CaCO_3$ | 2 mm pressure molding | 1,250 | Absence |
| | Second layer: 63MoB—10CrN—27Ni | 4 mm pressure molding | | |

*The total figures in the parentheses are 100 (wt %) and the figures after "+" show the added amounts (weight) based on the amount (weight) in the parentheses as 100.

TABLE 4

| | Heterogeneous surface layer of sintered alloy | | | | | Fine pores at surface portion | |
|---|---|---|---|---|---|---|---|
| | | | Composition (vol %) | | | | |
| Sample No. | Thickness (mm) | Hardness (HRA) | Dispersed phase | Binder phase | Hard phase | Diameter (μm) | Amount (vol %) |
| Present sample 18 | 0.3 | 85.8 | 15SrO | 20(Ni—Cr) | 65WC | 1.0 | 15 |
| Present sample 19 | 1.3 | 91.5 | 5CaO | 6Co | 89WC | 0.9 | 5 |
| Present sample 20 | 0.2 | 87.3 | 12SrO | 14(Ni—Mo) | 40TiC—34 (Ti,W,Ta,Mo)CN | 1.2 | 12 |
| Present sample 21 | 0.2 | 66.9 | 8SrO | 60(Fe—Co—W—Mo—Cr) | 15TiN—12VC—5WC | 1.5 | 8 |
| Present sample 22 | 0.5 | 82.9 | 10BaO | 24(Ni—Cr) | 66$Mo_2NiB_2$ | 0.7 | 10 |
| Present sample 23 | First layer: 0.8 | 86.1 | 10SrO | 20(Ni—Cr) | 70WC | 2.1 | 10 |
| | Second layer: 0.8 | 87.2 | 3SrO | 21(Ni—Cr) | 76WC | 1.9 | 3 |
| Present sample 24 | First layer: 1.6 | 83.7 | 11CaO | 19(Ni—Cr) | 80$Cr_3C_2$ | 2.5 | 11 |

TABLE 5

| | Inner portion of sintered alloy | | | Whole sintered alloy | |
|---|---|---|---|---|---|
| | | Composition (vol %) | | | |
| Sample No. | Hardness (HRA) | Binder phase | Hard phase | Specific gravity | Flexural strength (kgf/mm$^2$) |
| Present sample 18 | 88.0 | 27(Ni—Cr) | 73WC | 14.00 | 285 |
| Present sample 19 | 92.0 | 7Co | 93WC | 15.15 | 180 |
| Present sample 20 | 91.3 | 16(Ni—Mo) | 46TiC—38 (Ti,W,Ta,Mo)CN | 7.08 | 155 |
| Present sample 21 | 71.0 | 65(Fe—Co—W—Mo—Cr) | 16TiN—13V—6WC | 7.55 | 320 |
| Present sample 22 | 85.2 | 27(Ni—Cr) | 73$Mo_2NiB_2$ | 8.55 | 210 |
| Present | Third layer: 88.1 | 22(Ni—Cr) | 88WC | 13.87 | 280 |

TABLE 5-continued

| Sample No. | Inner portion of sintered alloy: Hardness (HRA) | Composition (vol %): Binder phase | Hard phase | Whole sintered alloy: Specific gravity | Flexural strength ($kgf/mm^2$) |
|---|---|---|---|---|---|
| sample 23 | | | | | |
| Present sample 24 | Second layer: 85.1 | 27(Ni—Cr) | $73Mo_2NiB_2$ | 8.04 | 215 |

Example 3

Among the respective samples obtained in Examples 1 and 2, Present samples 1, 2, 3, 6, 7, 11, 15 and 17 and Comparative samples 1 to 7 each comprising a disc of $\phi$25.0 mm $\times$10.0 mm in which one disc surface was lapped were used to carry out a friction test by the pin-on-disc method (pin: opposite materials, round rods, disc:sample discs) under the conditions of opposite materials of round rods with a diameter of 5 mm made of an A1 alloy and stainless steel, a load of 20 kgf (contact surface pressure:102 $kgf/cm^2$), a friction rate of 0.5 m/s, a friction time of one hour, an atmosphere of a water-soluble working solution when the A1 alloy rod was used and an atmosphere of a mineral oil with high purity when the stainless steel rod was used. The results are shown in Table 6.

TABLE 6

| Sample No. | Opposite material of Al alloy, in water-soluble working solution: Average friction coefficient | Depth of slide track ($\mu m$) | Opposite material of stainless steel, in oil with high purity: Average friction coefficient | Depth of slide track ($\mu m$) |
|---|---|---|---|---|
| Present sample 1 | 0.10 | 0.25 | 0.04 | 0.15 |
| Present sample 2 | 0.15 | 0.45 | 0.06 | 0.35 |
| Present sample 3 | 0.11 | 0.30 | 0.07 | 0.30 |
| Present sample 6 | 0.12 | 0.50 | 0.05 | 0.25 |
| Present sample 7 | 0.09 | 0.20 | 0.04 | 0.10 |
| Present sample 11 | 0.15 | 0.30 | 0.07 | 0.30 |
| Present sample 15 | 0.08 | 0.15 | 0.06 | 0.15 |
| Present sample 17 | 0.16 | 0.75 | 0.09 | 0.55 |
| Comparative sample 1 | 0.19 | 2.50 | 0.15 | 10.10 |
| Comparative sample 2 | 0.25 | 46.10 | 0.12 | 71.55 |
| Comparative sample 3 | 0.20 | 2.30 | 0.13 | 9.50 |
| Comparative sample 4 | 0.24 | 14.20 | 0.20 | 29.15 |
| Comparative sample 5 | 0.28 | 15.50 | 0.16 | 6.70 |
| Comparative sample 6 | 0.27 | 10.50 | 0.24 | 31.50 |
| Comparative sample 7 | 0.21 | 2.75 | 0.25 | 11.20 |

Example 4

The lapped surfaces of the same samples used in Example 3 were washed with water and dried, and then a small amount of a mineral oil with high purity was coated thereon. A friction test was carried out by the pin-on-disc method under the conditions of an opposite material of a round rod with a diameter of 5 mm made of high-speed steel (which corresponds to VD3 of Amerial Regulation (ASTM)) and a load of 10 kgf (contact surface pressure:51 $kgf/cm^2$) and a friction rate of 1.0 m/s, and time until when a friction coefficient exceeded 0.2 by seizure phenomenon was measured. The results are shown in Table 7.

TABLE 7

| Sample No. | Time until seizure occurs (min) |
|---|---|
| Present sample 1 | 75 |
| Present sample 4 | 64 |
| Present sample 9 | 81 |
| Present sample 10 | 105 |
| Present sample 12 | 34 |
| Present sample 16 | 56 |
| Comparative sample 1 | 5 |
| Comparative sample 2 | 25 (peripheral portion: minute chipping) |
| Comparative sample 3 | 7 |
| Comparative sample 4 | 2 |
| Comparative sample 5 | 5 |
| Comparative sample 6 | 6 |
| Comparative sample 7 | 4 |

The hard sintered alloys of the present invention have extremely excellent effects that the friction coefficients by wet friction are $\frac{2}{3}$ to $\frac{1}{3}$, the wear amounts are 1/5 to 100, and low friction coefficients can be maintained for a 10-fold time or more as compared with those of the conventional dense hard sintered alloys.

We claim:

1. A hard sintered alloy having fine pores which comprises 2 to 30% by volume of a dispersed phase of at least one of oxide, carbide and sulfide of calcium (Ca), strontium (Sr) or barium (Ba) and mutual solid solutions of these, and the balance of a binder phase comprising at least one metal of cobalt (Co), nickel (Ni) and iron (Fe) or an alloy containing said metal as a main component and a hard phase of at least one of carbide, nitride and boride of the 4b (titanium, zirconium and hafnium), 5b (vanadium, niobium and tantalum) or 6b (chromium, molybdenum and tungsten) group metal of the periodic table and mutual solid solutions of these, with a volume ratio of said binder phase to said hard phase being 2:98 to 95:5, wherein said fine pores are formed by removing said dispersed phase from a surface portion of said sintered alloy and wherein said dispersed phase has an average particle size of 0.5 to 20 $\mu m$, and said fine pores have an average diameter of 0.5 to 20 $\mu m$.

2. An alloy according to claim 1, wherein said dispersed phase has an average particle size of 2 to 5 $\mu m$, and said fine pores have an average diameter of 2 to 5 $\mu m$.

3. An alloy according to claim 1, wherein said binder phase comprises an alloy containing Co and/or Ni as a main component(s), said hard phase comprises at least one of carbide and nitride of the 4b, 5b or 6b group metal of the periodic table and mutual solid solutions of these, and the volume ratio of said binder phase to said hard phase is 2: 98 to 50:50.

4. An alloy according to claim 3, wherein said binder phase is a Co and/or Ni alloy in which tungsten (W) or molybdenum (Mo) is dissolved, and said hard phase contains at least one of tungsten carbide, titanium carbide, titanium nitride and mutual solid solutions of these as a main component(s).

5. An alloy according to claim 1, wherein said binder phase comprises an alloy containing Fe as a main component, said hard phase comprises at least one of carbide and nitride of the 4b, 5b or 6b group metal of the periodic table and mutual solid solutions of these, and the volume ratio of said binder phase to said hard phase is 30:70 to 95:5.

6. An alloy according to claim 5, wherein said binder phase is an Fe alloy in which at least one of carbon (C), chromium (Cr), Mo, W, Ni and Co is dissolved, and said hard phase contains at least one of titanium carbide, vanadium carbide, tungsten carbide, titanium nitride and mutual solid solutions of these as a main component(s).

7. An alloy according to claim 1, wherein said binder phase comprises an alloy containing at least one of Co, Ni and Fe as a main component, said hard phase comprises at least one of boride of the 4b, 5b or 6b group metal of the periodic table, Co, Ni and Fe and mutual solid solutions of these, and the volume ratio of said binder phase to said hard phase is 5:95 to 70:30.

8. An alloy according to claim 7, wherein said binder phase is an alloy of Cr, Mo and/or W and at least one of Co, Ni and Fe, and said hard phase contains complex boride containing Mo and/or W and at least one of Co, Ni and Fe, as a main component(s).

9. A hard sintered alloy having fine pores which comprises a sintered alloy comprising 2 to 30% by volume of a dispersed phase of at least one of oxide, carbide and sulfide of Ca, Sr or Ba and mutual solid solutions of these, 10% by volume or less of free carbon and/or boron nitride, and the balance of a binder phase comprising at least one metal of Co, Ni and Fe or an alloy containing said metal as a main component and a hard phase of at least one of carbide, nitride and boride of the 4b, 5b or 6b group metal of the periodic table and mutual solid solutions of these, with a volume ratio of said binder phase to said hard phase being 2:98 to 95:5, wherein fine pores are formed by removing said dispersed phase from a surface portion of said sintered alloy.

10. An alloy according to claim 9, wherein said dispersed phase has an average particle size of 0.5 to 20 μm, and said fine pores have an average diameter of 0.5 to 20 μm.

11. An alloy according to claim 9, wherein said binder phase comprises an alloy containing Co and/or Ni as a main component(s), said hard phase comprises at least one of carbide and nitride of the 4b, 5b or 6b group metal of the periodic table and mutual solid solutions of these, and the volume ratio of said binder phase to said hard phase is 2: 98 to 50:50.

12. An alloy according to claim 11, wherein said binder phase is a Co and/or Ni alloy in which tungsten (W) or molybdenum (Mo) is dissolved, and said hard phase contains at least one of tungsten carbide, titanium carbide, titanium nitride and mutual solid solutions of these as a main component (s).

13. An alloy according to claim 9, wherein said binder phase comprises an alloy containing Fe as a main component, said hard phase comprises at least one of carbide and nitride of the 4b, 5b or 6b group metal of the periodic table and mutual solid solutions of these, and the volume ratio of said binder phase to said hard phase is 30:70 to 95:5.

14. An alloy according to claim 13, wherein said binder phase is an Fe alloy in which at least one of carbon (C), chromium (Cr), Mo, W, Ni and Co is dissolved, and said hard phase contains at least one of titanium carbide, vanadium carbide, tungsten carbide, titanium nitride and mutual solid solutions of these as a main component (s).

15. An alloy according to claim 9, wherein said binder phase comprises an alloy containing at least one of Co, Ni and Fe as a main component, said hard phase comprises at least one of boride of the 4b, 5b or 6b group metal of the periodic table, Co, Ni and Fe and mutual solid solutions of these, and the volume ratio of said binder phase to said hard phase is 5:95 to 70:30.

16. An alloy according to claim 15, wherein said binder phase is an alloy of Cr, Mo and/or W and at least one of Co, Ni and Fe, and said hard phase contains complex boride containing Mo and/or W and at least one of Co, Ni and Fe, as a main component(s).

17. A hard sintered alloy having fine pores which comprises a sintered alloy comprising a hard phase of at least one of carbide, nitride and boride of the 4b, 5b or 6b group metal of the periodic table and mutual solid solutions of these and a binder phase comprising at least one metal of Co, Ni and Fe or an alloy containing said metal as a main component(s), with a volume ratio of said binder phase to said hard phase being 2:98 to 95:5, having a heterogeneous surface layer comprising 2 to 30% by volume of a dispersed phase comprising at least one of oxide, carbide and sulfide of Ca, Sr or Ba and mutual solid solutions of these, 10% by volume or less of free carbon and/or boron nitride and the balance of said hard phase and said binder phase, formed on the partial or whole surface of said sintered alloy, wherein fine pores are formed by removing said dispersed phase from a surface portion of said heterogeneous surface layer.

18. An alloy according to claim 1, wherein the fine pores contain a lubricating substance.

19. An alloy according to claim 17, wherein the fine pores have an average particle size of 0.5 to 20 μm.

20. An alloy according to claim 9, which comprises at least three percent by volume of said free carbon and/or boron nitride.

* * * * *